US006299278B1

(12) United States Patent
Hanabusa et al.

(10) Patent No.: US 6,299,278 B1
(45) **Date of Patent: *Oct. 9, 2001**

(54) HEAD WIPING MECHANISM FOR INK JET PRINTER

(75) Inventors: Tadashi Hanabusa, Irvine; Masanori Kaneko, Fountain Valley; Makoto Takemura, Irvine, all of CA (US)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/019,192

(22) Filed: Feb. 5, 1998

(51) Int. Cl.[7] ..... B41J 2/165
(52) U.S. Cl. ..... 347/33; 347/23
(58) Field of Search ..... 347/33, 23, 24, 347/32

(56) References Cited

U.S. PATENT DOCUMENTS 5,103,244 * 4/1992 Gast et al. ..... 347/33
5,440,331 * 8/1995 Grange ..... 347/32
5,500,660 * 3/1996 Childers et al. ..... 347/33
5,565,898 * 10/1996 Sakuma ..... 347/23
5,745,133 * 4/1998 Hendricks et al. ..... 347/33
5,793,388 * 8/1998 Martinson et al. ..... 347/19
5,917,517 * 6/1999 Kida et al. ..... 347/33

FOREIGN PATENT DOCUMENTS 0 698 495 * 2/1996 (EP) .

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

A printer assembly providing quick and effective wiping of print heads. The printer assembly includes a carriage for holding a print head and having a slide contact, a slide having a wiper ramp, a carriage contact contactable by the slide contact of the carriage, and a wiper assembly including a base, a post extending from the base, a wiper arm, a wiper latch, a wiper holder, and a wiper blade, wherein the wiper arm is connected to the base such that the wiper arm is raised in a case that the wiper arm ramp moves laterally relative to and while in contact with the wiper arm, the wiper latch is connected to the wiper arm such that the wiper latch latches onto the post extending from the base in a case that the wiper arm is sufficiently raised, the wiper holder is connected to the wiper arm, and the wiper blade is connected to the wiper holder.

43 Claims, 10 Drawing Sheets

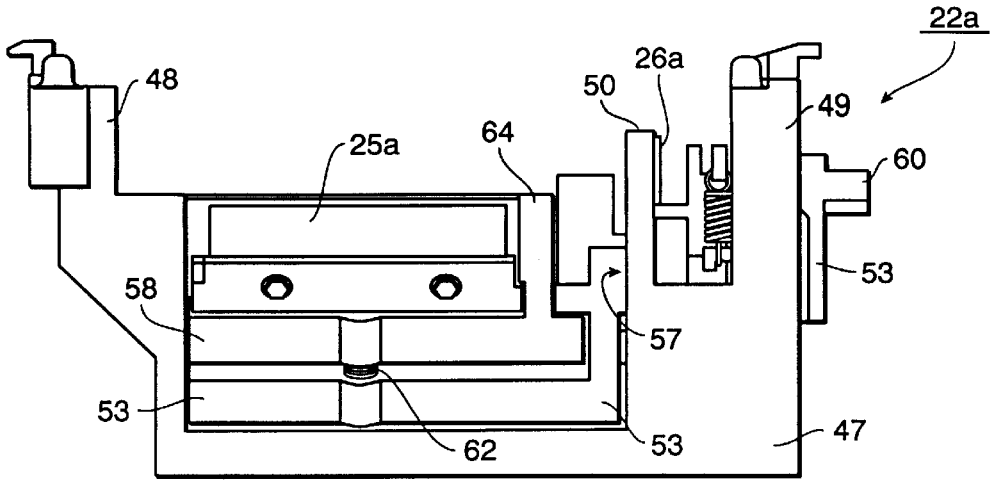
FIG. 6A
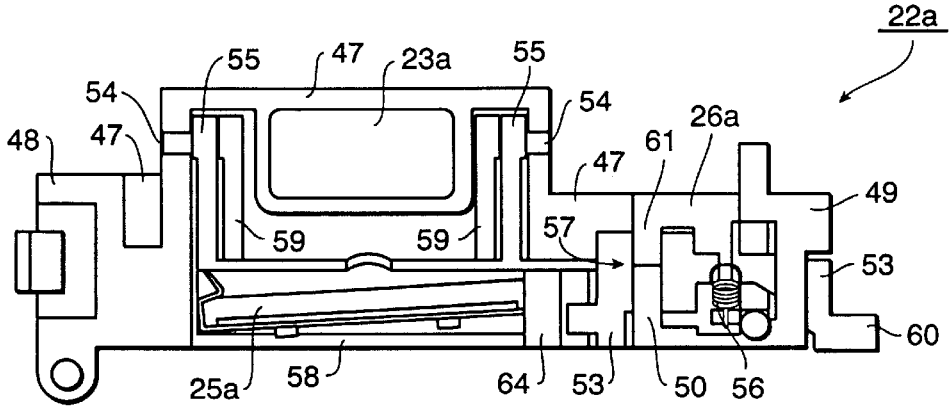
FIG. 6B
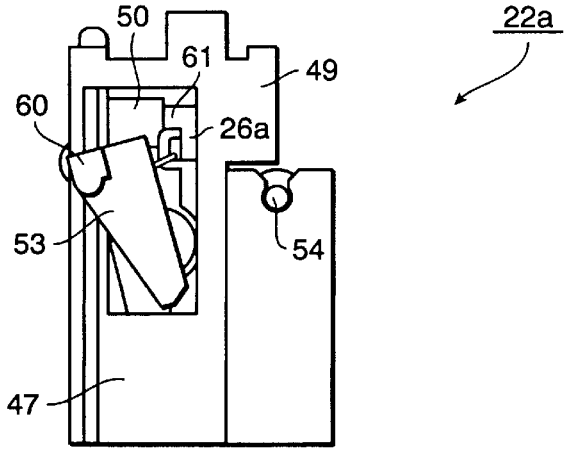
| |
|---|
| FIG. 6A |
| FIG. 6B |
| FIG. 6C |
FIG. 6
FIG. 6C

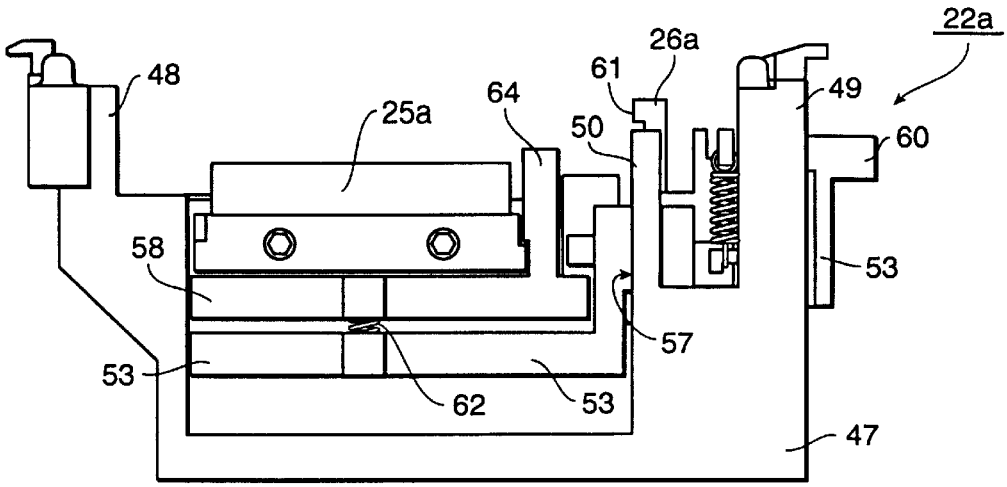
FIG. 7A
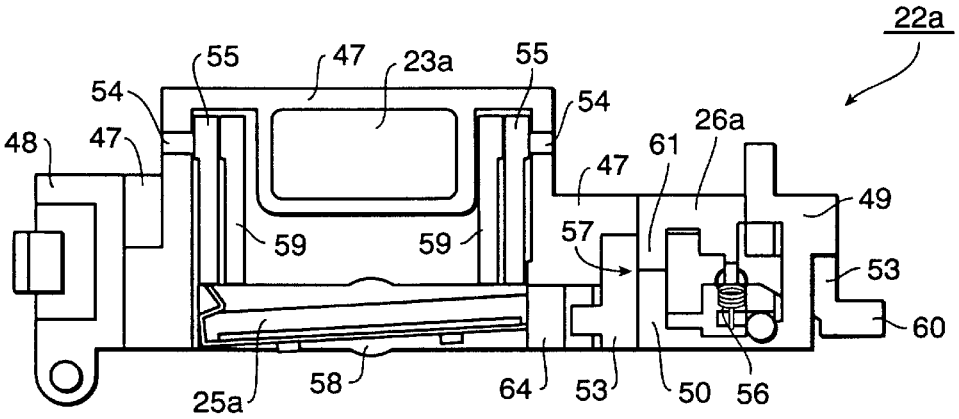
FIG. 7B
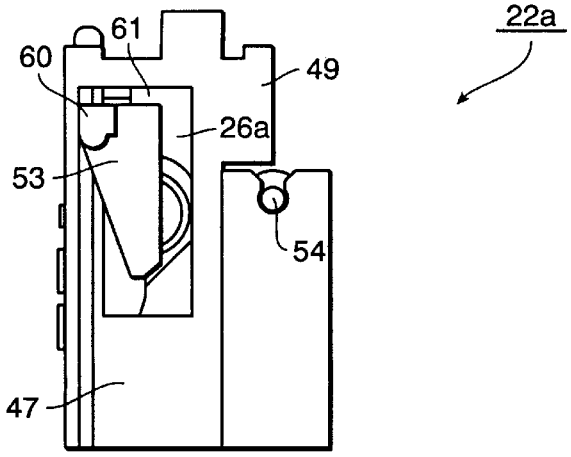
FIG. 7C
| |
|---|
| FIG. 7A |
| FIG. 7B |
| FIG. 7C |
FIG. 7

HEAD WIPING MECHANISM FOR INK JET PRINTER

BACKGROUND OF THE INVENTION

Field of the Invention

The present invention relates to systems for removing excess ink from ink jet print head nozzles. More particularly, the present invention relates to a system for wiping external ink from nozzle opening of an ink jet print head.

Conventional ink jet printers utilize ink jet print heads to print pixels upon a recording medium. Ink jet print heads contain ink jet nozzles which eject ink droplets onto the recording medium through nozzle openings. Over time, ink collects on or near the ink jet nozzle openings, thereby tending to clog the nozzle openings.

Due to the foregoing, many conventional ink jet printers provide systems for cleaning ink from ink jet nozzles before, during, or after printing. One such system is a wiping system, in which an element is moved across ink jet nozzle openings so as to wipe ink from the openings.

In order to clean the ink jet nozzles most effectively, such wiping cannot occur at normal print speeds. Rather, the print head must move in relation to the wiping element at a speed much slower than normal printing speeds. Accordingly, nozzle wiping slows the printing process.

For example, in conventional wiping systems, an ink jet print head is moved out of a printing area to a wiping station. At the wiping station, a wiping element is moved relative to the ink jet print head so as to wipe the nozzles of the ink jet print head, the wiping element is lowered, and printing resumes. Accordingly, what is needed is a system for quickly and effectively wiping ink jet nozzles.

Ink jet nozzle wiping is more problematic in a case of dual-head ink jet printing. Dual-head ink jet printers utilize two ink jet print heads, each print head having a set of ink jet nozzles. In order to provide wiping of each set of nozzles, some dual head printing systems provide one wiper outside of a printing area. Accordingly, such systems are capable of wiping a first print head and then printing with the first print head while wiping the second print head. It should be noted that due to the slow speed at which wiping must occur, printing by the first print head proceeds much slower than in conventional printing.

Accordingly, what is also needed is a system which provides for simultaneous wiping of two ink jet print heads and which causes minimal printing delays.

SUMMARY OF THE INVENTION

The present invention addresses the foregoing problems by providing a wiping system directly triggered by movement of a carriage containing an ink jet print head. As a result, the present invention provides fast nozzle wiping.

In one aspect, the invention is a printer assembly including a carriage, a slide and a wiper assembly. The carriage is for holding a print head and includes a slide contact. The slide includes a wiper ramp and a carriage contact contactable by the slide contact of the carriage. The wiper assembly includes a base, a post extending from the base, a wiper arm, a wiper latch, a wiper holder, and a wiper blade. The wiper arm is connected to the base such that the wiper arm is raised in a case that the wiper arm ramp moves laterally relative to and while in contact with the wiper arm. The wiper latch is connected to the wiper arm such that the wiper latch latches onto the post extending from the base in a case that the wiper arm is sufficiently raised. The wiper holder is connected to the wiper arm, and the wiper blade is connected to the wiper holder.

By virtue of the foregoing arrangement, the printer assembly can quickly and effectively wipe ink jet nozzles of a print head.

Preferably, the carriage includes a wiper latch contact for unlatching the wiper latch during lateral movement of the carriage. Also, in the preferred embodiment, the printer assembly includes a second wiper assembly, the carriage holds a second print head, and the slide has a second wiper arm ramp.

In another aspect, the invention is a wiper assembly including a base, a post extending from the base, a wiper arm connected to the base, a wiper latch connected to the wiper arm, a wiper holder connected to the wiper arm, and a wiper blade connected to the wiper holder. The wiper latch is connected to the wiper arm such that the wiper latch latches onto the post in a case that the wiper arm is sufficiently raised, thereby holding the wiper blade in a raised position.

Preferably, the wiper arm is pivotally connected to the base, and the wiper latch is pivotally connected to the wiper arm. In addition, a latch spring is connected to the base and to the wiper latch such that the latch spring holds the wiper latch against the post and urges the wiper arm downward.

The foregoing wiper assembly arrangement can be used to quickly and effectively wipe ink jet nozzles of a print head before, during and after printing.

In another aspect, the invention is a method of wiping a print head with a wiper blade. The method includes the steps of moving a carriage laterally in a first direction so as to push a slide, raising a wiper arm using a ramp in the slide, thereby raising the wiper blade, and latching a wiper latch to hold the wiper blade at a raised position. The method also includes the steps of moving the carriage laterally in a second direction opposite to the first direction, wiping the print head with the raised wiper blade as the carriage moves in the second direction, unlatching the wiper latch using the carriage, and lowering the wiper blade.

In the preferred embodiment, in a case that the wiper latch is unlatched, the wiper blade is lowered via a latch spring. In addition, the carriage unlatches the wiper latch by pushing the wiper latch during lateral movement.

In a further aspect, the invention is a method of wiping plural print heads with plural wiper blades. The method includes the steps of moving a carriage laterally in a first direction, raising the plural wiper blades, holding the wiper blades at respective raised positions, and wiping each of the print heads with a respective one of the raised wiper blades as the carriage moves in a second direction opposite to the first direction.

The invention also contemplates a method of wiping plural print heads with plural wiper blades which includes the steps of moving a carriage in a first direction to raise the wiper blades, and wiping each of the plural print heads with a respective one of the raised wiper blades as the carriage moves in a second direction opposite to the first direction.

In still another aspect, the invention is a method of wiping plural print heads with plural wiper blades. The method includes the steps of moving a carriage laterally in a first direction so as to push a slide, raise plural wiper arms using plural ramps in the slide, thereby raising the plural wiper blades, and latching plural wiper latches to hold the wiper blades at respective raised positions. The method also includes the steps of moving the carriage laterally in a second direction opposite to the first direction, wiping each of the print heads with respective ones of the raised wiper blades as the carriage moves in the second direction, unlatching the wiper latches using the carriage, and lowering the wiper blades.

In the preferred embodiment, when the wiper latches are unlatched, the wiper blades are lowered via latch springs. In addition, the carriage unlatches the wiper latches by pushing the wiper latches.

In yet another aspect, the invention is a method of wiping plural print heads with plural wiper blades. The method includes the step of determining if a predetermined time has elapsed since a last wiping. The method also includes the steps of moving a carriage laterally in a first direction to raise the wiper blades in a case that the predetermined time has elapsed since the last wiping, and wiping each of the print heads with a respective one of the raised wiper blades as the carriages moves in a second direction opposite to the first direction.

The invention also concerns a method of wiping plural print heads with plural wiper blades including the step of determining if one of plural counters, each of which counts a quantity of ink ejection, has counted to a threshold value. The method also includes the steps of moving a carriage in a first direction to raise the wiper blades in a case that one of the counters has counted to the threshold value, and wiping each of the print heads with a respective one of the raised wiper blades as the carriages moves in a second direction opposite to the first direction.

In another aspect, the invention is a method of wiping plural print heads with plural wiper blades. The method includes the steps of determining if a predetermined time has elapsed since a last wiping and determining if one of plural counters, each of which counts a quantity of ink ejection, has counted to a threshold value. The method also includes the steps of moving a carriage laterally in a first direction to raise the wiper blades in a case that the predetermined time has elapsed since the last wiping and in a case that one of the counters has counted to the threshold value, and wiping each of the print heads with a respective one of the raised wiper blades as the carriages moves in a second direction opposite to the first direction.

Advantageously, the foregoing methods provide quick and effective wiping of ink jet nozzles of a print head and thereby increase printing speed.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

FIG. 6, comprising FIGS. 6A through 6C, are views of a wiper assembly according to the invention, in a wiper down position.

FIG. 7, comprising FIGS. 7A through 7C, are views of a wiper assembly according to the invention, in a wiper up position.

DETAILED DESCRIPTION OF THE PREFERRED EMBODIMENTS

Figure 1:
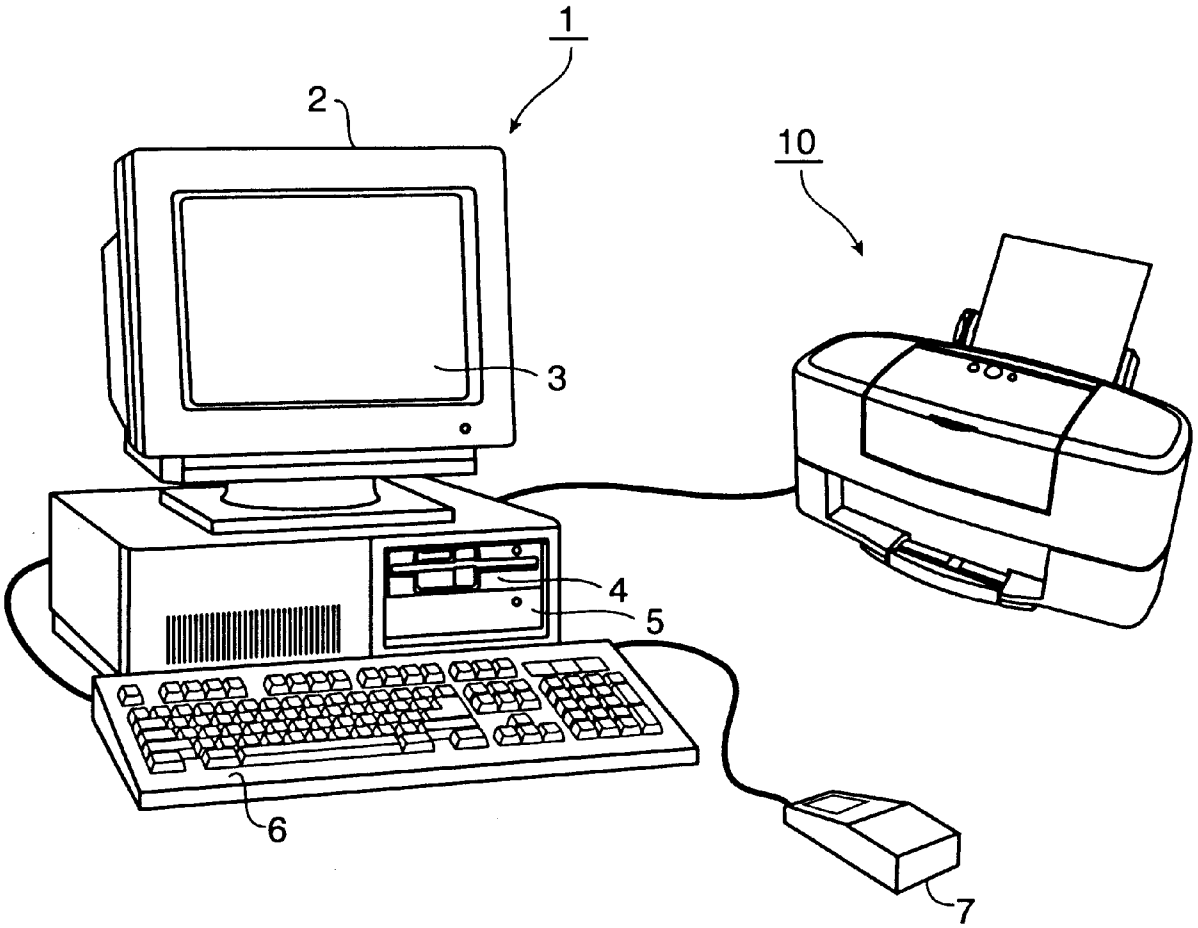
FIG. 1 shows a perspective view of computing equipment used in connection with a printer assembly according to the invention.

FIG. 1 is a view showing the outward appearance of computing equipment using connection with the invention described herein. Computing equipment 1 includes host processor 2. Host processor 2 comprises a personal computer (herein after "PC"), preferably an IBM PC-compatible computer having a windowing environment, such as Microsoft® Windows 95. Provided with computing equipment 1 are display screen 3 comprising a color monitor or the like, keyboard 6 for entering text data and user commands, and pointing device 7. Pointing device 7 preferably comprises a mouse for pointing to and for manipulating objects displayed on display screen 3.

Computing equipment 1 includes a computer-readable memory medium, such as fixed computer disk 5, and floppy disk interface 4. Floppy disk interface 4 provides a means whereby computing equipment 1 can access information, such as data files, application programs, etc., stored on floppy disks. A similar CD-ROM interface (not shown) may be provided with computing equipment 1 through which computing equipment 1 can access information stored on a CD-ROM.

Disk 5 stores, among other things, application programs by which host processor 2 generates files, manipulates and stores those files on disk 5, presents data in those files to an operator via display screen 3, and prints data in those files via printer 10. Disk 5 also stores an operating system which, as noted above, is preferably a windowing operating system. Device drivers are also stored on disk 5. At least one of the device drivers comprises a printer driver which provides a software interface to firmware in printer 10.

In preferred embodiments of the invention, printer 10 is a multi-head serial printer. Accordingly, although the invention described herein is not limited to use with such a printer, the invention will be described in the context of such a printer.

Figure 2:
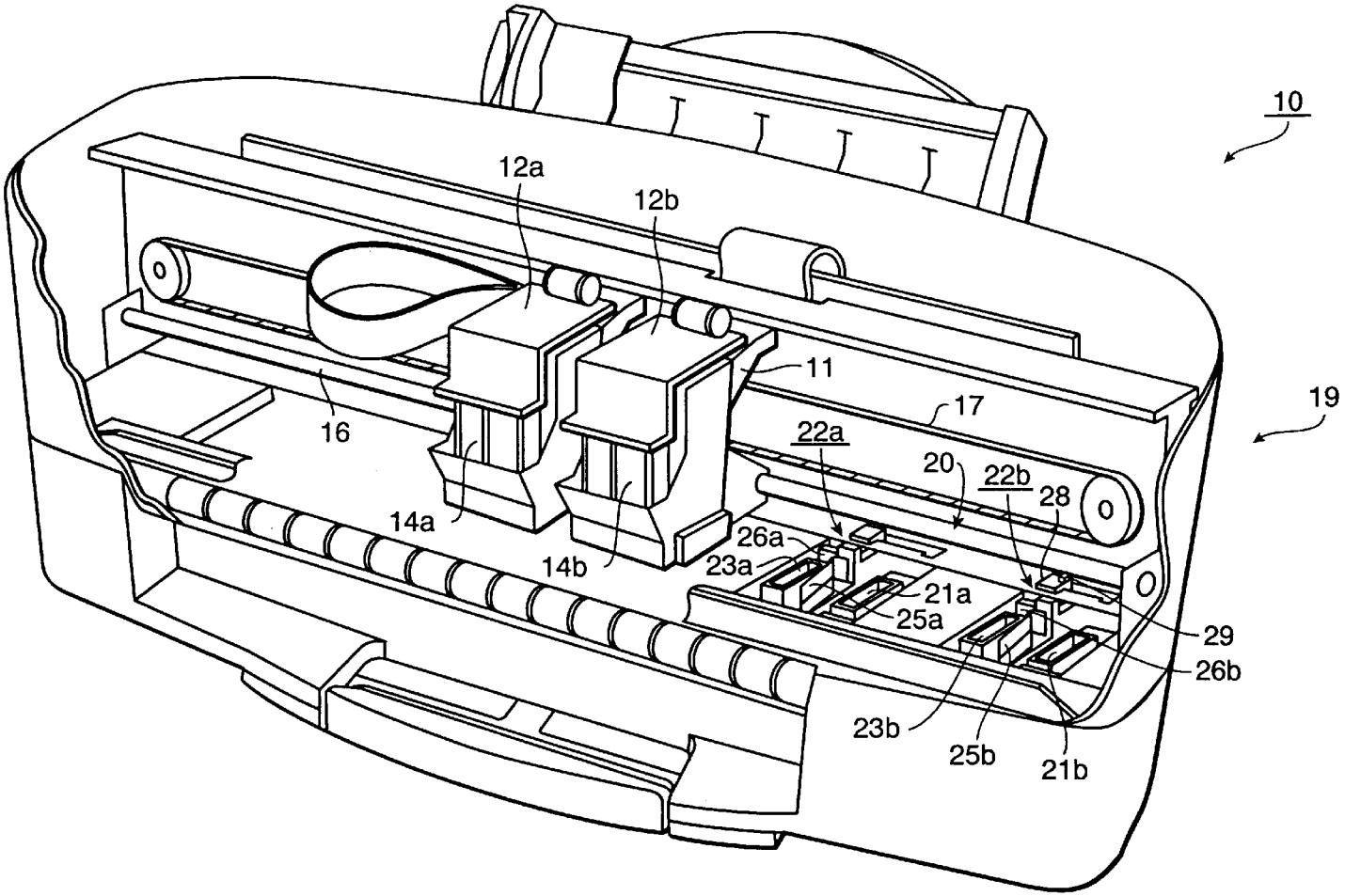
FIG. 2 is a front, cut-away perspective view of the printer shown in FIG. 1.

In this regard, FIG. 2 is a front, cut-away perspective view of printer 10. As shown in FIG. 2, printer 10 is a dual-cartridge printer which prints images using two print heads (i.e., one head per cartridge). Each print head has multiple ink jet nozzles which are used to print data upon a recording medium.

In more detail, cartridges 14*a* and 14*b* each contain a print head and are held in receptacles 12*a* and 12*b*, respectively. Receptacles 12*a* and 12*b* in turn are parts of carriage 11. Carriage 11 is pulled laterally along bar 16 by belt 17, which is driven by a carriage motor (not shown). As carriage 11 moves, the ink jet nozzles of the print heads are commanded to eject ink droplets in accordance with print data. Carriage 11 can move both left to right and right to left, providing for dual-directional printing as needed.

Over time, the ink jet nozzles tend to clog. Therefore, the nozzles require intermittent cleaning, such as by the wiping system of the invention.

In response to commands from host processor 2 or commands from internal printer control logic, carriage 11 is moved toward home side 19 of printer 10, to home position 20. Carriage 11 is moved to home position 20, for example, when printer 10 is idle, when printer 10 is turned off, when paper is being ejected from printer 10, or when the print heads of cartridges 14*a* and 14*b* need to be cleaned.

Disposed at home position 20 so as to clean the print heads are ink suction devices 21*a* and 21*b*, wiper assemblies 22*a* and 22*b*, and ink expulsion receptacles 23*a* and 23*b*.

Ink suction devices 21*a* and 21*b* preferably comprise a rotary pump and print head connection caps. The print head connection caps connect to the print heads of cartridges 14*a* and 14*b* during print head cleaning and at other times, such as when printer 10 is powered off, so as to protect the print heads.

Ink expulsion receptacles 23*a* and 23*b* preferably receive ink optionally expelled from the print heads after the print heads are wiped.

Also shown in FIG. 2 are wiper blades 25*a* and 25*b* and latches 26*a* and 26*b* of wiper assemblies 22*a* and 22*b*. Additionally, slide 28 is shown having carriage contact 29, which interacts with wiper assemblies 22*a* and 22*b* and carriage 11 during print head wiping operations, as described in more detail below.

Figure 3:
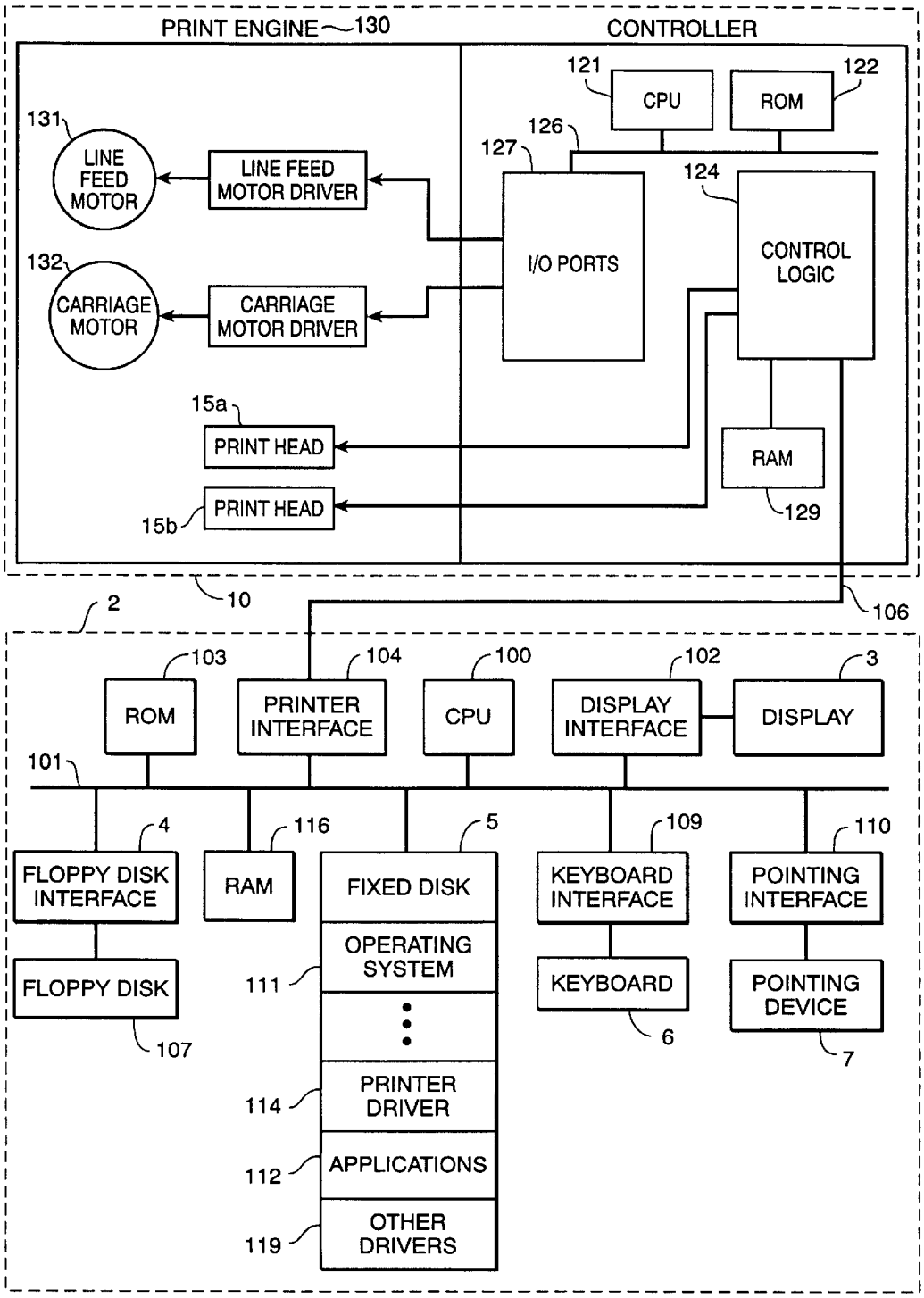
FIG. 3 is a block diagram showing the hardware configuration of a host processor interfaced to a printer having a printer assembly according to the invention.

FIG. 3 is a block diagram showing the internal functional structure of host processor 2 and printer 10. In FIG. 3, host processor 2 includes a central processing unit 100 such as a programmable microprocessor interfaced to computer bus 101. Also coupled to computer bus 101 are display interface 102 for interfacing to display 3, printer interface 104 for interfacing to printer 10 through bi-directional communication line 106, floppy disk interface 4 for interfacing to floppy disk 107, keyboard interface 109 for interfacing to keyboard 6, and pointing device interface 110 for interfacing to pointing device 7. Disk 5 includes an operating system section for storing operating system 111, an applications section for storing application files 112, and a printer driver section for storing printer driver 114.

A random access main memory (hereinafter "RAM") 116 interfaces to computer bus 101 to provide CPU 100 with access to memory storage. In particular, when executing stored computer-executable process steps such as those associated with application files 112, CPU 100 loads those application instruction sequences from disk 5 (or other storage media such as media accessed via a network or floppy disk interface 4) into RAM 116 and executes those stored program instruction sequences out of RAM 116. RAM 116 provides for a print data buffer used by printer driver 114. It should also be recognized that standard disk-swapping techniques available under the windowing operating system allow segments of memory, including the aforementioned print data buffer, to be swapped on and off of disk 5.

Read only memory (hereinafter "ROM") 103 in host processor 2 stores invariant instruction sequences, such as start-up instruction sequences or basic input/output operating system (BIOS) sequences for operation of keyboard 6.

As shown in FIG. 3, and as previously mentioned, disk 5 stores program instruction sequences for a windowing operating system and for various application programs such as graphics application programs, drawing application programs, desktop publishing application programs, and the like. In addition, disk 5 also stores color image files such as might be displayed by display 3 or printed by printer 10 under control of a designated application program. Disk 5 also stores a color monitor driver in other drivers section 119 which controls how multi-level RGB color primary values are provided to display interface 102. Printer driver 114 controls printer 10 for both black/white and color printing and supplies print data for printout according to the configuration of printer 10. Print data is transferred to printer 10, and control signals are exchanged between host processor 2 and printer 10, through printer interface 104 connected to line 106 under control of printer driver 114. Other device drivers are also stored on disk 5 for providing appropriate signals to various devices, such as network devices, facsimile devices, and the like, connected to host processor 2.

Printer 10 includes CPU 121 such as an 8-bit or a 16-bit microprocessor, ROM 122, control logic 124, and I/O ports unit 127 connected to bus 126. Also connected to control logic 124 is RAM 129. Control logic 124 includes controllers for line feed motor 131, for carriage motor 132, for print image buffer storage in RAM 129, for heat pulse generation, and for print head data. Control logic 124 also provides control signals and print data for print heads 15*a* and 15*b* of print engine 130.

I/O ports unit 127 is coupled to print engine 130. In print engine 130, print heads 15*a* and 15*b* perform recording on a recording medium by scanning across the recording medium while printing using print data from a print buffer in RAM 129. Control logic 124 is also coupled to printer interface 104 of host processor 2 via communication line 106 for exchange of control signals and to receive print data and print data addresses. ROM 122 stores font data, program instruction sequences used to control printer 10, and other invariant data for printer operation. RAM 129 stores print data in a print buffer defined by printer driver 114 and other information for printer operation.

Although FIG. 3 shows individual components of printer 10 as separate and distinct from one another, it ig preferable that some of the components be combined. For example, control logic 124 may be combined with I/O ports 127 in an ASIC to simplify interconnections for the functions of printer 10.

The structure and operation of printer 10 used for cleaning print heads is described below.

Briefly, a printer assembly according to the invention includes a carriage, a slide, and a wiper assembly. The carriage is for holding a print head and includes a slide contact. The slide includes a wiper ramp and a carriage contact contactable by the slide contact of the carriage. The wiper assembly includes a base, a post extending from the base, a wiper arm, a wiper latch, a wiper holder, and a wiper blade. The wiper arm is connected to the base such that the wiper arm is raised in a case that the wiper arm ramp moves laterally relative to and while in contact with the wiper arm. The wiper latch is connected to the wiper arm such that the wiper latch latches onto the post in a case that the wiper arm is sufficiently raised. The wiper holder is connected to the wiper arm, and the wiper blade is connected to the wiper holder. In the preferred embodiment described below, the printer assembly includes a second wiper assembly, the carriage holds a second print head and the slide has a second wiper arm ramp.

Figure 4:
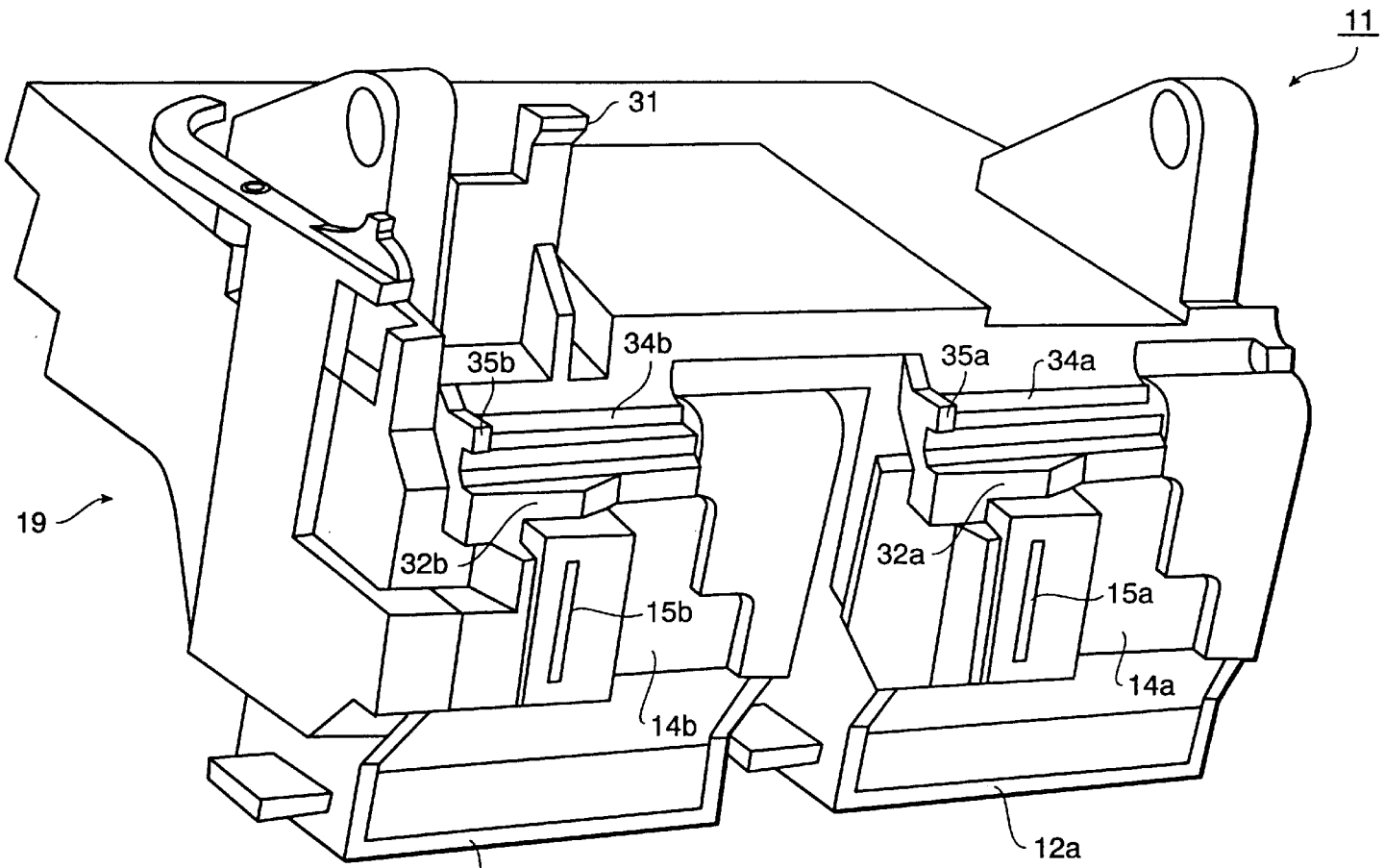
FIG. 4 is a perspective view of the bottom and rear of a carriage according to the invention.

FIG. 4 is a perspective view of the bottom and rear of a carriage according to the invention. Due to the orientation of FIG. 4, home side 19 is located to the left of the figure.

Carriage 11 has two receptacles 12*a* and 12*b* for holding cartridges 14*a* and 14*b*. At the bottom of cartridges 14*a* and

14*b* are print heads 15*a* and 15*b*. cartridges 14*a* and 14*b* can be removed from receptacles 12*a* and 12*b* for replacement or repair.

Disposed near the bottom of carriage 11 is slide contact 31. This contact is preferably a small protrusion extending from the rear of carriage 11. In the preferred embodiment, slide contact 31 is near the side of carriage 11 that is closest to home side 19. As carriage 11 moves towards home position 20, slide contact 31 of carriage 11 encounters and pushes carriage contact 29 of slide 28.

Ledges 32*a* and 32*b* are disposed on the bottom of carriage 11, one corresponding to each of print heads 15*a* and 15*b*. The ledges are disposed near to the rear of carriage 11, parallel to the direction of carriage movement and substantially adjacent to print heads 15*a* and 15*b*. Each of ledges 32*a* and 32*b* serves to push against a wiper assembly spacer, discussed below, so as to ensure that only desired portions of wiper blades 25*a* and 25*b* encounter print heads 15*a* and 15*b*.

Wiper latch grooves 34*a* and 34*b* are also disposed near the rear of carriage 11 and parallel to the direction of carriage movement on the bottom of carriage 11. Wiper latch grooves 34*a* and 34*b* provide clearance for wiper latches 26*a* and 26*b* of the wiper assemblies, discussed below, so as to allow carriage 11 to move relative to wiper latches 26*a* and 26*b* for some distance without causing latches 26*a* and 26*b* to unlatch.

Wiper latch contacts 35*a* and 35*b* are disposed at the ends of grooves 34*a* and 34*b*, respectively, which are closest to home side 19. Contacts 35*a* and 35*b* close off wiper latch grooves 34*a* and 34*b*. Wiper latch contacts 35*a* and 35*b* push and thereby unlatch latched wiper latches 26*a* and 26*b* in a manner discussed below.

Figure 5:
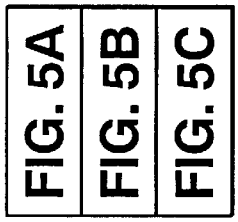
FIG. 5, comprising
Figure 5C:
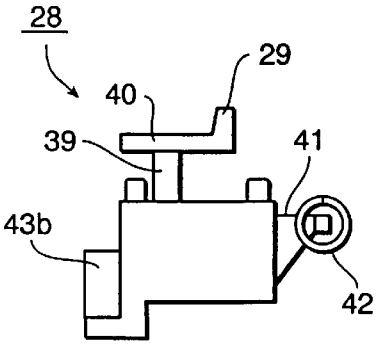
FIGS. 5A through 5C, are views of a slide according to the invention.
Figure 5B:
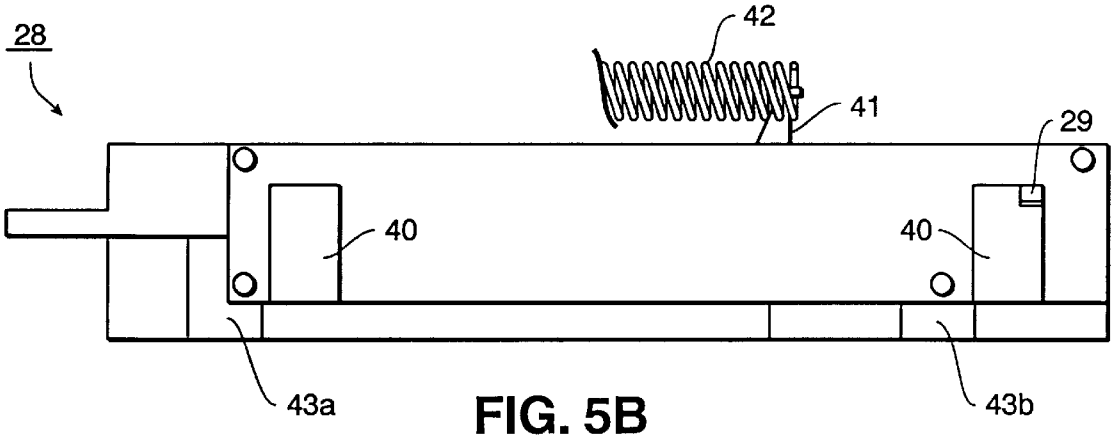
Figure 5A:
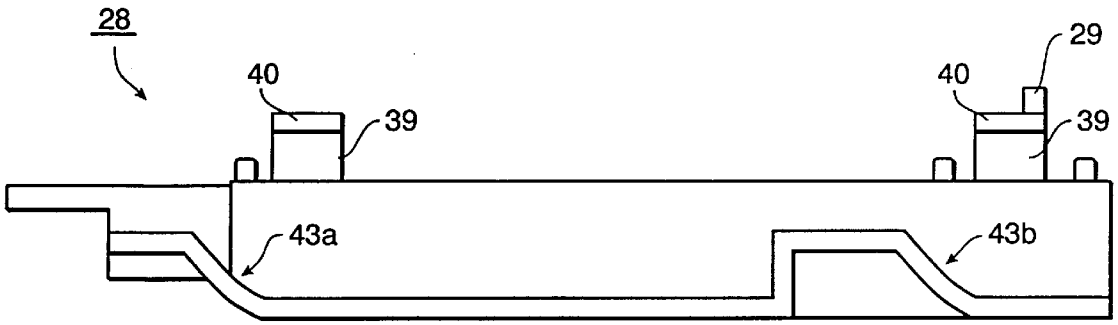

FIGS. 5A through 5C are views of a slide according to the invention. FIG. 5A is a front view, FIG. 5B is a top view and FIG. 5C is an end view of the slide.

Slide 28 is disposed near home position 20 in printer 10. Support posts 39 extend from the top of slide 28. Surmounting support posts 39 are support ledges 40, which sit on top of an interior surface (not shown) in printer 10. The remainder of slide 28 hangs below the interior surface. A slot in the surface accommodates support posts 39, allowing the slide to move laterally within printer 10.

Extending from support ledge 40 that is closest to home side 19 is carriage contact 29. As mentioned above, when carriage 11 moves towards home position 20, slide contact 31 of carriage 11 encounters and pushes carriage contact 29 of slide 28, thereby urging slide 28 in the direction of home side 19.

Spring post 41 extends from the rear of slide 28. Spring post 41 is connected to slide spring 42, which extends away from home side 19 so as to resist motion of slide 28 as slide 28 is pushed by slide contact 31 of carriage 11 toward home side 19.

Wiper arm ramps 43*a* and 43*b*, corresponding to print heads 15*a* and 15*b*, respectively, are disposed on the front of slide 28. Each wiper arm ramp slopes upward such that as slide 28 moves laterally toward home side 19 of printer 10, wiper arms (shown in FIGS. 6A to 6C, 7A to 7C, and 8) which are in contact with wiper arm ramps 43*a* and 43*b* are urged upward. Thus, slide 28 serves to translate the lateral movement of carriage 11 toward home position 20 into an upward movement of wiper arms contacting slide 28 at wiper arm ramps 43*a* and 43*b*.

The structure of wiper assembly 22*a* is discussed below. Briefly, a wiper assembly according to the invention includes a base, a post extending from the base, a wiper arm connected to the base, a wiper latch connected to the wiper arm such that the wiper latch latches onto the post extending from the base in a case that the wiper arm is sufficiently raised, a wiper holder connected to the wiper arm, and a wiper blade connected to the wiper holder, such that the wiper blade is raised to a raised position in a case that the wiper arm is raised.

Preferably, the wiper arm is pivotally connected to the base, and the wiper latch is pivotally connected to the wiper arm. Additionally, in the preferred embodiment, the wiper assembly includes a latch spring and a blade spring. The latch spring is connected to the base and to the wiper latch such that the latch spring holds the wiper latch against the post and urges the wiper arm downward. The wiper holder is connected to the wiper arm via the blade spring. Also, the wiper holder preferably includes a wiper spacer that extends past the top of the wiper blade.

In this regard, FIGS. 6A to 6C show wiper assembly 22*a* in a wiper-down position and including wiper blade 25*a* and latch 26*a* of FIG. 2. FIG. 6A is a front view, FIG. 6B is a top view, and FIG. 6C is an end view of wiper assembly 22*a* in the wiper-down position. It should be noted that a second, substantially similar wiper assembly is provided in printer 10 and includes wiper blade 25*b* and latch 26*b* of FIG. 2.

Wiper assembly 22*a* includes wiper base 47. Wiper base 47 has three protrusions extending vertically therefrom. Two of these protrusions are supports 48 and 49, which hold wiper assembly 22*a* in printer 10. The third protrusion is post 50, which is disposed between supports 48 and 49. In the preferred embodiment, base 47 also includes ink expulsion receptacle 23*a*. As shown, ink expulsion receptacle 23*a* is a hollow rectangular passage through base 47. In addition, in the preferred embodiment, base 47 is made from a suitable material such as plastic.

Wiper assembly 22*a* also includes wiper arm 53, which extends from inside of support 48, across wiper assembly 22*a* and past support 49. Wiper arm 53 includes tab 60 extending therefrom which, when wiper assembly 22*a* is positioned in printer 10, rests on wiper arm ramp 43*a* of slide 28. Thus, when slide 28 moves laterally toward home side 19 of printer 10, tab 60 extending from wiper arm 53 is urged upward by wiper arm ramp 43*a*. Wiper arm 53 is connected to wiper base 47 such that wiper arm 53 is raised in response to the upward motion of tab 60.

In the preferred embodiment, wiper arm 53 is pivotally connected to wiper base 47 at wiper arm pivot 54 via arms 55. Thus, wiper arm 53 is not raised in a linear manner when tab 60 of wiper arm 53 is urged upward by wiper arm ramp 43*a*. Instead, wiper arm 53 rotates around wiper arm pivot 54, which is positioned such that the resulting motion of wiper arm 53 is generally upward.

Wiper latch 26*a* is connected to wiper arm 53 such that wiper latch 26*a* latches onto post 50 in a case that wiper arm 53 is sufficiently raised. Overhang 61 extends from the top of wiper latch 26*a*. In the preferred embodiment, latch spring 56 is disposed go as to hold wiper latch 26*a* against post 50 and to hold wiper latch 26*a* onto the top of post 50 once wiper latch 26*a* is latched to post 50. Thus, as wiper arm 53 is raised, wiper latch 26*a* is pressed against post 50 by latch spring 56. Once overhang 61 of wiper latch 26*a* moves vertically past post 50, overhang 61 is urged onto the top of post 50 by latch spring 56, thereby latching wiper latch 26*a* onto post 50. If wiper latch 26*a* latches onto post 50, wiper arm 53 remains raised even if no longer urged upward.

In the preferred embodiment, latch spring 56 also urges latch 26*a* downward. In this regard, wiper latch 26*a* preferably is pivotally connected to wiper arm 53 at wiper latch pivot 57. Thus, latch spring 56 also urges wiper arm 53 downward. Accordingly, once wiper latch 26*a* is unlatched from post 50, latch spring 56 lowers wiper arm 53.

Wiper assembly 22*a* also includes wiper holder 58 connected to wiper arm 53 by blade spring 62. Wiper holder 58 is preferably pivotally connected to wiper base 47 at wiper arm pivots 54 via arms 59. Thug, wiper holder 56 moves concentrically with wiper arm 53 such that if wiper arm 53 is raised, wiper holder 58 is also raised.

Wiper blade 25*a* is attached to wiper holder 58. Accordingly, when wiper holder 58 is raised, wiper blade 25*a* is also raised. Therefore, when wiper arm 53 is raised, wiper blade 25*a* is raised.

Wiper blade 25*a* is preferably made from a material suitable for wiping a print head. As print heads are typically somewhat delicate, a soft rubber or plastic is suitable for use as wiper blade 25*a*.

Wiper spacer 64 extends vertically from wiper holder 58 past the top of wiper blade 25*a*. Wiper spacer 64 functions in conjunction with ledge 32*a* of carriage 11 so as to ensure that only a desired portion of wiper blade 25*a* comes into contact with print head 15*a* during wiping.

It should be noted that the portion of wiper blade 25*a* that contacts print head 15*a* during wiping is determined by the physical interrelationship of ledge 32*a*, wiper blade 25*a*, and spacer 64. Accordingly, ledge 32*a*, wiper blade 25*a*, and spacer 64 should be configured so that the exposed surfaces of ink jet nozzles of print head 15*a* are wiped using at least the top edge of wiper blade 25*a*.

FIGS. 7A to 7C show wiper assembly 22*a* according to the invention, in a wiper-up position. FIG. 7A is a front view, FIG. 7B is a top view, and FIG. 7C is an end view of wiper assembly 22*a* in the wiper-up position.

In order to achieve the wiper-up position according to the invention, wiper arm 53 is raised by wiper arm ramp 43*a*, thereby raising wiper latch 26*a* until overhang 61 latches onto post 50. Wiper arm 53 also raises wiper holder 58, which raises wiper blade 25*a*. Because wiper latch 26*a* is latched onto post 50, wiper arm 53 and thus wiper holder 58 and wiper blade 25*a* remain in the wiper-up position until wiper latch 26*a* is unlatched from post 50. Wiper latch 26*a* can be unlatched from post 50 by being pushed such that overhang 61 of wiper latch 26*a* is no longer over the top of post 50. In the preferred embodiment, wiper latch contact 35*a* of carriage 11 pushes wiper latch 26*a* after carriage 11 moves print head 15*a* past raised wiper blade 15*a*.

Figure 8:
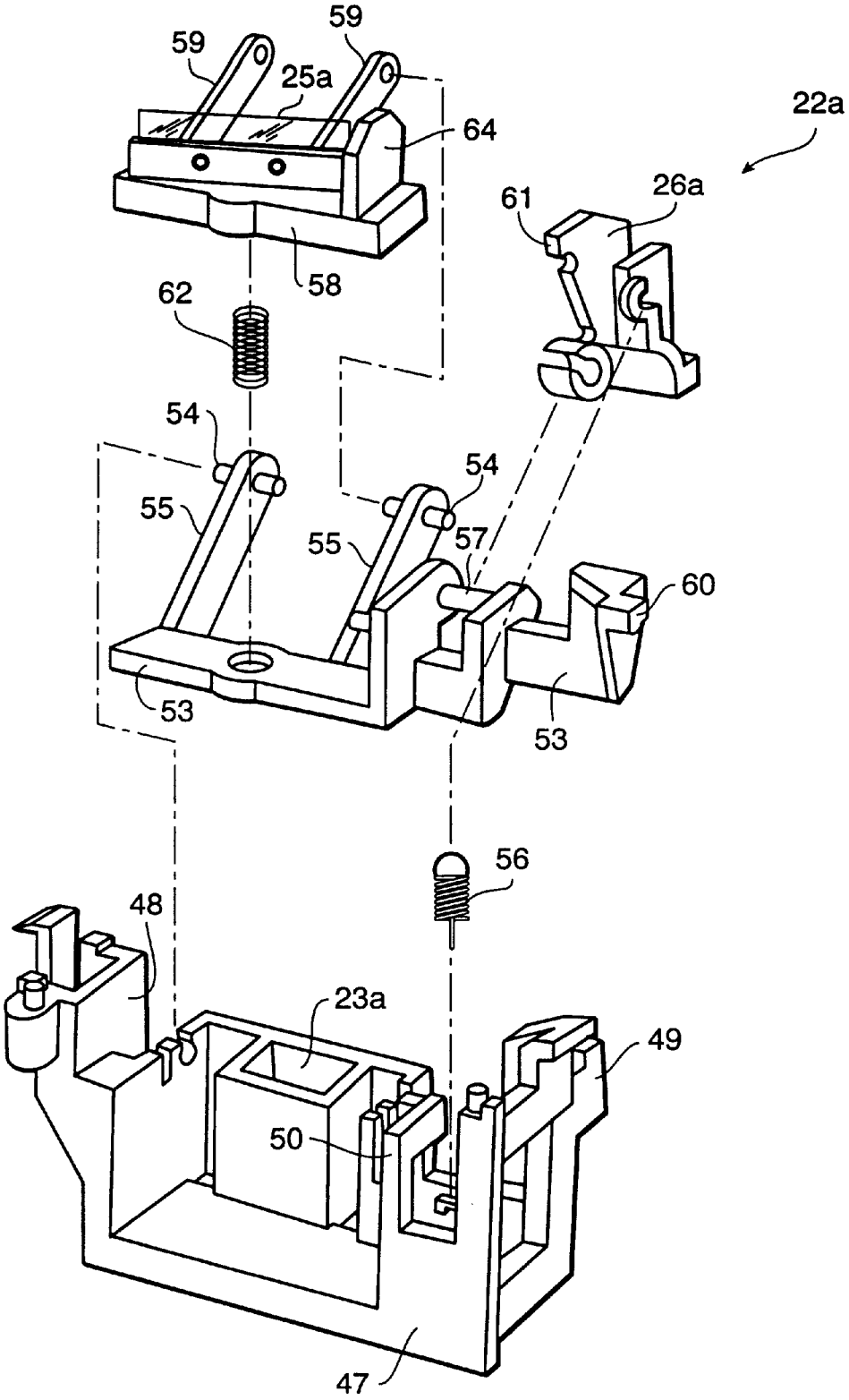
FIG. 8 is an exploded view of a wiper assembly according to the invention.

In order to more clearly illustrate a wiper assembly according to the invention, FIG. 8 shows an exploded view of wiper assembly 22*a* of FIGS. 6 and 7. Illustrated in FIG. 8 is wiper base 47, wiper arm 53, wiper latch 26*a*, wiper holder 58, and wiper blade 25*a*. Wiper base 47 is shown having ink expulsion receptacle 23*a*, supports 48 and 49, and post 50. Wiper arm 53 is also shown having tab 60, arms 55, wiper arm pivots 54, and wiper latch pivot 57. Moreover, wiper latch 26*a* is shown having overhang 61 and wiper holder 58 is shown having wiper blade 25*a*, arms 59 and wiper spacer 64. Also shown are latch spring 56 and blade spring 62.

In operation, in a case that one or both of print heads 15*a* and 15*b* in carriage 11 needs to be cleaned, carriage motor 132 drives belt 17 so as to move carriage 11 to home position 20. As carriage 11 moves into home position 20, wiper blades 25*a* and 25*b* of wiper assemblies 22*a* and 22*b* are raised to the wiper-up position, as discussed in more detail below. When carriage 11 reaches home position 20, ink suction devices 21*a* and 21*b* optionally suction ink from print heads 15*a* and 15*b* so as to clear the nozzles of print heads 15*a* and 15*b*. Next, the carriage motor is actuated so as to move carriage 11 from home position 20, away from home side 19 of printer 10. As carriage 11 moves, print heads 15*a* and 15*b* pass across raised wiper blades 25*a* and 25*b*, respectively. Wiper blades 25*a* and 25*b* wipe excess ink from print heads 15*a* and 15*b*. After print heads 15*a* and 15*b* have been wiped, wiper blades 25*a* and 25*b* are lowered, as discussed below in more detail.

Figure 9:
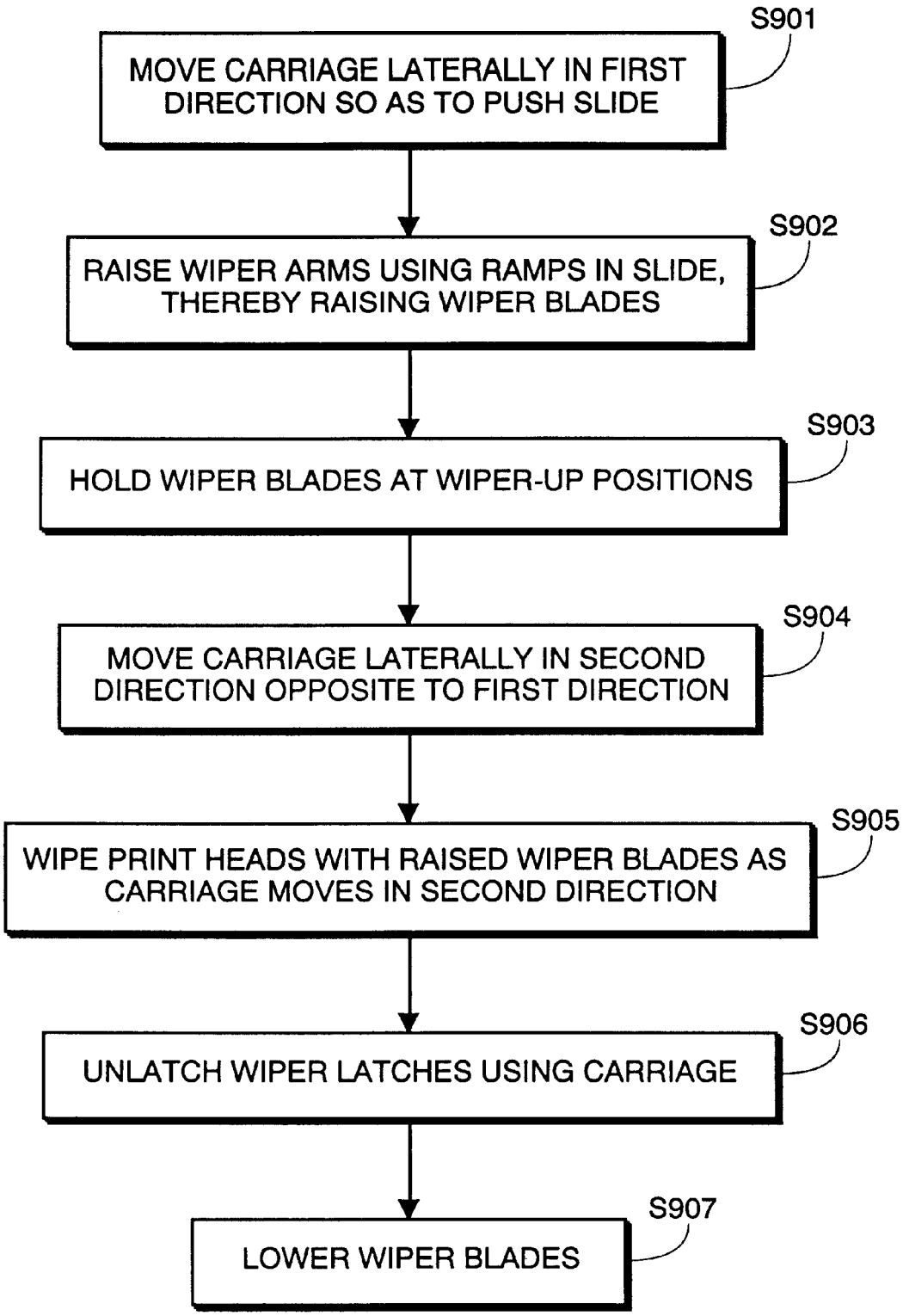
FIG. 9 is a flowchart for describing wiping of plural print heads according to the invention.

The operation of the wiper assemblies in raising the wiper blades, wiping the print heads, and lowering the wiper blades is discussed in more detail below with respect to FIG. 9.

Briefly, such an operation includes the steps of moving a carriage laterally in a fixed direction so a to push a slide, raising plural wiper arms using plural ramps in the slide, thereby raising the wiper blades, and latching plural wiper latches to hold the wiper blades at respective raised positions. The method also includes the steps of moving the carriage laterally in a second direction opposite to the first direction, wiping each of the print heads with a respective one of the raised wiper blades as the carriage moves in the second direction, unlatching the wiper latches using the carriage, and lowering the wiper blades.

It should be noted that in the following discussion, a letter "a" appended to a reference numeral indicates an element associated with wiper assembly 22*a*, and a letter "b" appended to a reference numeral indicates an element associated with wiper assembly 22*b*. The reference numerals themselves correspond to the reference numerals in the above discussion of FIGS. 6, 7 and 8. For example, wiper holders 58*a* and 58*b* have the same construction and function as wiper holder 58 discussed above and correspond respectively to wiper assemblies 22*a* and 22*b*.

In step S901, carriage 11 moves laterally in a first direction towards home position 20. As carriage 11 moves, slide contact 31 of carriage 11 comes into contact with carriage contact 29 of slide 28, thereby pushing slide 28 toward home side 19 of printer 10.

In step S902, wiper arm ramps 43*a* and 43*b* raise wiper arms 53*a* and 53*b*, respectively. As described above, the raising of wiper arms 53*a* and 53*b* raises wiper holders 58*a* and 58*b*, as well as wiper blades 25*a* and 25*b*.

Ramps 43*a* and 43*b* are preferably disposed with respect to wiper arms 53*a* and 53*b* such that a wiper blade is raised after being passed over by print heads having a home position closer to home side 19 than the wiper blade. For example, in the preferred embodiment, wiper blade 25*a* is not raised until print head 15*b* has passed over wiper blade 25*a*.

In step S903, wiper latches 26*a* and 26*b*, which also raise in response to the raising of wiper arms 53*a* and 53*b*, latch onto posts 50*a* and 50*b* using overhangs 61*a* and 61*b* and wiper latch springs 56*a* and 56*b*.

In step S904, carriage 11 moves laterally away from home position 20. Therefore, carriage 11 moves in step S904 in a direction opposite to the direction in which carriage 11 moved in step S901.

In step S905, as carriage 11 moves away from home position 20, print heads 15*a* and 15*b* are wiped by wiper blades 25*a* and 25*b*, respectively. Wiping in step S905 preferably occurs simultaneously so as to shorten an amount of time needed to perform wiping. As each of print heads 15*a* and 15*b* passes its respective wiper blade 25*a* and 25*b*, ledges 32*a* and 32*b* of carriage 11 come into contact with spacers 64*a* and 64*b*, respectively. During this contact, wiper holders 58*a* and 58*b* and spacers 64*a* and 64*b* are urged upward by blade springs 62*a* and 62*b*, respectively, thereby pressing spacers 64*a* and 64*b* against ledges 32*a* and 32*b*, respectively. The urging of wiper holders 58*a* and 58*b* ensures firm contact between wiper blades 25*a* and 25*b* and print heads 15*a* and 15*b*, respectively. Simultaneously, contact between ledges 32*a* and 32*b* and spacers 64*a* and 64*b* ensures that only desired portions of wiper blades 25*a* and 25*b* come into contact with print heads 15*a* and 15*b*, respectively.

During step S905, wiper latches 26*a* and 26*b* are latched so as to keep wiper blades 25*a* and 25*b* in raised positions. In order to prevent carriage 11 from unlatching wiper latches 26*a* and 26*b*, wiper latches 26*a* and 26*b* move within wiper latch grooves 34*a* and 34*b*, respectively.

In step S906, carriage 11 unlatches wiper latches 26*a* and 26*b*. In step S906, respective ones of wiper latch contacts 35*a* and 35*b* contact wiper latches 26*a* and 26*b* after wiper latches 26*a* and 26*b* have moved through wiper latch grooves 34*a* and 34*b*, respectively. Accordingly, wiper latch contact 35*a* pushes wiper latch 26*a* off of post 50*a*, and wiper latch contact 35*b* pushes wiper latch 26*b* off of post 50*b*. Advantageously, wiper latch contact 35*a* unlatches wiper latch 26*a* before print head 15*b* passes wiper blade 25*a*. Accordingly, print head 15*b* is wiped only by wiper blade 25*b*.

In step S907, wiper blades 25*a* and 25*b* are lowered in response to the unlatching of wiper latches 26*a* and 26*b*. In the preferred embodiment, wiper blades 25*a* and 25*b* are lowered by the urging of wiper arms 53*a* and 53*b* downward by latch springs 56*a* and 56*b*.

By virtue of the foregoing structure and operation, plural print heads can be simultaneously, quickly and effectively wiped.

Figure 10:
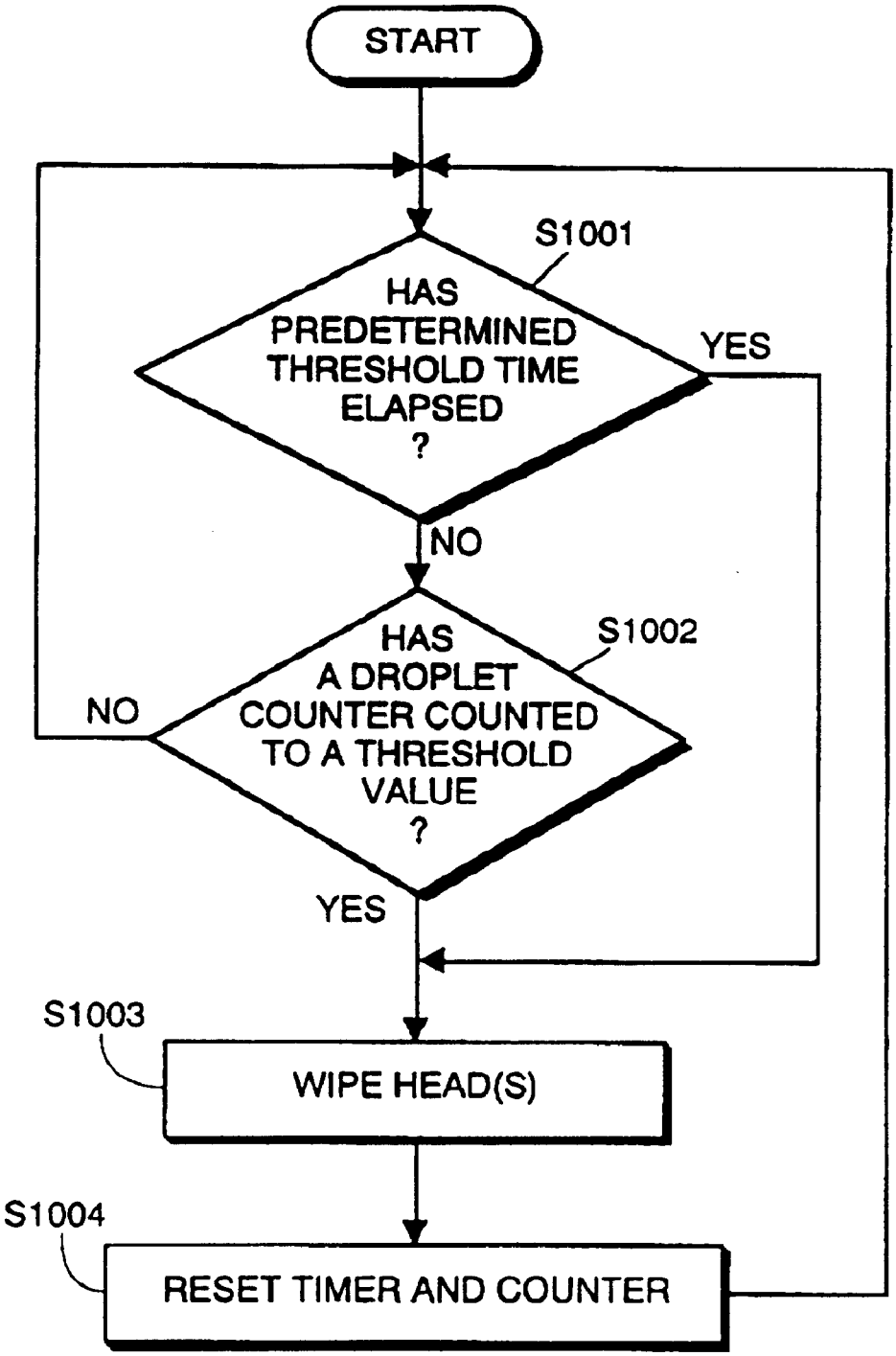
FIG. 10 is a flowchart for describing a process to wipe plural print heads according to the invention.

FIG. 10 is a flowchart for describing computer-executable process steps to wipe plural print heads according to the invention. The process steps are preferably embodied in printer driver 114 stored on disk 5 and executed by CPU 100. Of course, the process steps may be obtained from a source other than printer driver 114 and may also be executed by CPU 121 or by both CPU 100 and CPU 121.

Briefly, the process steps include a step to determine if a predetermined time has elapsed since a last wiping and to determine if one of plural counters, each of which counts a quantity of ink ejection, has counted to a threshold value. The process steps also include a step to move a carriage laterally in a first direction to raise wiper blades in a case that the predetermined time has elapsed since the last wiping or in a case that one of the counters has counted to the threshold value, and a step to wipe each of the print heads with a respective one of the raised wiper blades as the carriage moves in a second direction opposite to the first direction.

In more detail, the above steps may use a timer and a counter or counters. Such a timer or counter(s) may be located in host processor 2 or printer 10. Alternatively, a general purpose timer or counter(s), such as circuitry found in CPU 100, may also be used. Preferably, the timer and counter(s) are part of control logic 124 or are emulated in software executed by CPU 100.

Referring to FIG. 10, step S1001 is reached once printing begins. In step S1001, it is determined if a predetermined threshold time has elapsed since a last wiping operation. In the preferred embodiment, a timer measures the elapsed time since the last wiping operation by resetting after each wiping operation. If the timer indicates that the threshold time has elapsed, flow proceeds to step S1003; if not, flow proceeds to step S1002.

In step S1002, it is determined if a droplet counter has counted to a predetermined threshold value. Similarly to the above-described timer, a droplet counter counts an amount of ink ejection since a last wiping by resetting after each wiping. If a droplet counter has counted to the threshold value, flow proceeds to step S1003; if not, flow returns to step S1001.

In the preferred embodiment, plural droplet counters are used, one for each of print heads 15*a* and 15*b*. In this case, each droplet counter counts the number of ink droplets ejected from the corresponding print head since a last wiping. Alternatively, a single counter can be used to count the total number of ink droplets ejected from all print heads. In the alternative case, the predetermined threshold value will likely be approximately twice the value of values used in the preferred embodiment.

The thresholds used in steps S1001 and S1002 can be fixed for use with any type of print head. For example, the threshold time can be fixed at sixty seconds, and the threshold value can be fixed at 6 million droplets. However, in preferred embodiments, the thresholds depend on the type of print heads used during printing. Table I shows some examples of Canon™ ink jet print heads and their corresponding threshold values.

TABLE I

Examples of Droplet and Time Thresholds

| Print Head | Nozzle | Threshold Value | Threshold Time |
|---|---|---|---|
| BC-21, BC-22, | Black | 6 million | 60 seconds |
| BC-21e, or BC-22e | Color | 1.5 million | 60 seconds |
| BC-20 or BC-23 | Black | 25 million | 60 seconds |

Although all threshold times are equal in Table I, this need not be the case. Preferably, if two print heads are used, each corresponding to different threshold times, the shorter threshold time is used in step S1001.

It should be noted that the order of steps S1001 and S1002 can be interchanged. In addition, in alternative embodiments, only one of steps S1001 or S1002 is used to determine whether or not wiping is appropriate. For example, in an alternative embodiment, the occurrence of wiping operations is determined solely by a droplet counter.

In step S1003, a print head wiping operation is performed. This wiping operation preferably proceeds as explained above with respect to FIGS. 1 to 9. After wiping, flow proceeds to step S1004, where the timer and the counter(s) are reset. Flow then returns to step S1001.

By virtue of the above operation, the invention provides wiping of plural print heads at appropriate moments during printing.

While the present invention is described above with respect to what is currently considered its preferred embodiments, it is to be understood that the invention is not limited to that described above. To the contrary, the invention is intended to cover various modifications and equivalent arrangements included within the spirit and scope of the appended claims.

What is claimed is:

1. A printer assembly comprising:

a carriage for holding a print head, the carriage including a slide contact;

a slide including a wiper arm ramp and a carriage contact contactable by the slide contact of the carriage; and a wiper assembly including a base, a post extending from the base, a wiper arm connected to the base such that the wiper arm is raised in a case that the wiper arm ramp moves laterally relative to the wiper arm while in contact with the wiper arm, a wiper latch connected to the wiper arm such that the wiper latch latches onto the post extending from the base in a case that the wiper arm is sufficiently raised, a wiper holder connected to the wiper arm, and a wiper blade connected to the wiper holder.

2. The printer assembly of claim 1, wherein the wiper arm is pivotally connected to the base.

3. The printer assembly of claim 1, wherein the wiper latch is pivotally connected to the wiper arm.

4. The printer assembly of claim 1, wherein the carriage further includes a wiper latch contact for unlatching the wiper latch during lateral movement of the carriage.

5. The printer assembly of claim 4, wherein the wiper assembly further includes a latch spring connected to the base and to the wiper latch for holding the wiper latch against the post and for urging the wiper arm downward.

6. The printer assembly of claim 1, wherein the wiper assembly further includes a blade spring and wherein the wiper holder is connected to the wiper arm via the blade spring.

7. The printer assembly of claim 1, wherein the wiper assembly further includes a wiper spacer connected to the wiper holder such that the wiper spacer extends vertically past the wiper blade.

8. The printer assembly of claim 1, further comprising a second wiper assembly, wherein the carriage holds a second print head and the slide has a second wiper arm ramp.

9. The printer assembly of claim 1, wherein the base of the wiper assembly includes an ink expulsion receptacle.

10. A wiper assembly comprising:

a base;

a post extending from the base;

a wiper arm connected to the base;

a wiper latch connected to the wiper arm such that the wiper latch latches onto the post extending from the base in a case that the wiper arm is sufficiently raised;

a wiper holder connected to the wiper arm;

and a wiper blade connected to the wiper holder, wherein the wiper blade is raised in a case that the wiper arm is raised.

11. The wiper assembly of claim 10, wherein the wiper arm is pivotally connected to the base.

12. The wiper assembly of claim 10, wherein the wiper latch is pivotally connected to the wiper arm.

13. The wiper assembly of claim 10, further comprising a latch spring connected to the base and to the wiper latch such that the latch spring holds the wiper latch against the post and urges the wiper arm downward.

14. The wiper assembly of claim 10, further comprising a blade spring, wherein the wiper holder is connected to the wiper arm via the blade spring.

15. The wiper assembly of claim 10, wherein the wiper holder further comprises a wiper spacer that extends vertically past the wiper blade.

16. The wiper assembly of claim 10, wherein the base further includes an ink expulsion receptacle.

17. A method of wiping a print head with a wiper blade, the wiper blade being raisable by a wiper arm of a wiper assembly having a base, comprising the steps of:

moving a carriage laterally in a first direction so as to push a slide;

raising a wiper arm using a ramp in the slide, thereby raising the wiper blade;

latching a wiper latch onto a post extending from the base of the wiper assembly to hold the wiper blade at a raised position;

moving the carriage laterally in a second direction opposite to the first direction;

wiping the print head with the raised wiper blade as the carriage moves in the second direction;

unlatching the wiper latch using the carriage; and lowering the wiper blade.

18. The method of claim 17, wherein the wiper arm pivots upward when raised.

19. The method of claim 17, wherein the wiper blade is lowered via a latch spring.

20. The method of claim 17, wherein the carriage unlatches the wiper latch by pushing the wiper latch.

21. A method of wiping plural print heads with plural wiper blades, comprising the steps of:

moving a carriage laterally in a first direction so as to push a slide having plural wiper arm ramps;

raising the plural wiper blades by raising plural wiper arms using the plural wiper arm ramps;

holding the wiper blades at respective raised positions; and wiping each of the print heads with a respective one of the raised wiper blades as the carriage moves in a second direction opposite to the first direction.

22. The method of claim 21, wherein the wiper arms pivot upward when raised.

23. The method of claim 21, wherein the wiper blades are held at the respective raised positions via plural wiper latches, and further comprising the step of lowering each wiper blade via a latch spring.

24. The method of claim 23, further comprising the step of unlatching the wiper latches by pushing the wiper latches with the carriage.

25. A method of wiping plural print heads with plural wiper blades, comprising the steps of:

moving a carriage in a first direction to raise the plural wiper blades;

latching plural wiper latches onto plural posts, each of the plural posts extending from the base of a respective one of plural wiper assemblies, thereby holding the wiper blades at respective raised positions; and wiping each of the plural print heads with a respective one of the raised wiper blades as the carriage moves in a second direction opposite to the first direction.

26. A method of wiping plural print heads with plural wiper blades, comprising the steps of:

determining if one of plural predetermined times has elapsed since a last wiping, each of the predetermined times corresponding to a respective print head, wherein each of the plural predetermined times are concurrently monitored;

moving a carriage laterally in a first direction to raise the wiper blades in a case that at least one of the plural predetermined times has elapsed since the last wiping; and wiping each of the print heads with a respective one of the raised wiper blades as the carriages moves in a second direction opposite to the first direction.

27. The method of claim 26, wherein each of the plural predetermined times corresponds to a type of print head.

28. A method of wiping plural print heads with plural wiper blades, comprising the steps of:

determining if one of plural counters, each of which counts a quantity of ink ejection from a corresponding print head, has counted to a threshold value, wherein each of the plural counters are concurrently monitored;

moving a carriage in a first direction to raise the plural wiper blades in a case that one of the counters has counted to the threshold value;

wiping each of the print heads with a respective one of the raised wiper blades as the carriages moves in a second direction opposite to the first direction.

29. The method of claim 28, wherein the threshold value depends on the type of print head used during printing.

30. A method of wiping plural print heads with plural wiper blades, comprising the steps of:

determining if one of plural predetermined times has elapsed since a last wiping, each of the predetermined times corresponding to a respective print head, wherein each of the plural predetermined times are concurrently monitored;

determining if one of plural counters, each of which counts a quantity of ink ejection from a corresponding print head, has counted to a threshold value, wherein each of the plural counters are concurrently monitored;

moving a carriage laterally in a first direction to raise the wiper blades in a case that at least one of the plural predetermined times has elapsed since the last wiping or in a case that one of the counters has counted to the threshold value; and wiping each of the print heads with a respective one of the raised wiper blades as the carriage moves in a second direction opposite to the first direction.

31. The method of claim 30, wherein each of the plural predetermined times corresponds to a type of print head.

32. The method of claim 30, wherein the threshold value depends on the type of print head used during printing.

33. A method of wiping plural print heads with plural wiper blades, the wiper blades being respectively raisable by plural wiper arms, each wiper arm being in a respective wiper assembly having a base, comprising the steps of:

moving a carriage laterally in a first direction so as to push a slide;

raising plural wiper arms using plural ramps in the slide, thereby raising the wiper blades;

latching each of plural wiper latches onto a post extending from the base of the respective wiper assembly to hold the wiper blades at respective raised positions;

moving the carriage laterally in a second direction opposite to the first direction;

wiping each of the print heads with a respective one of the raised wiper blades as the carriage moves in the second direction;

unlatching the wiper latches using the carriage; and lowering the wiper blades.

34. The method of claim 33, wherein the wiper arms pivot upward when raised.

35. The method of claim 33, wherein each wiper blade is lowered via a latch spring.

36. The method of claim 33, wherein the carriage unlatches the wiper latches by pushing the wiper latches.

37. A computer-readable memory medium storing computer-executable process steps to wipe plural print heads with plural wiper blades, the steps comprising:

a determining step to determine if one of plural predetermined times has elapsed since a last wiping, each of the predetermined times corresponding to a respective print head, wherein each of the plural predetermined times are concurrently monitored;

a moving step to move a carriage laterally in a first direction to raise the wiper blades in a case that at least one of the plural predetermined times has elapsed since the last wiping; and a wiping step to wipe each of the print heads with a respective one of the raised wiper blades as the carriage moves in a second direction opposite to the first direction.

38. The computer-readable memory medium of claim 37, wherein each of the plural predetermined times corresponds to a type of print head.

39. A computer-readable memory medium storing computer-executable process steps to wipe plural print heads with plural wiper blades, the steps comprising:

a determining step to determine if one of plural counters, each of which counts a quantity of ink ejection from a corresponding print head, has counted to a threshold value, wherein each of the plural counters are concurrently monitored;

a moving step to move a carriage in a first direction to raise the plural wiper blades in a case that one of the counters has counted to the threshold value; and a wiping step to wipe each of the print heads with a respective one of the raised wiper blades as the carriages moves in a second direction opposite to the first direction.

40. The computer-readable memory medium of claim 39, wherein the threshold value depends on the type of print head used during printing.

41. A computer-readable memory medium storing computer-executable process steps to wipe plural print heads with plural wiper blades, the steps comprising:

a determining step to determine if one of plural predetermined times has elapsed since a last wiping, each of the predetermined times corresponding to a respective print head, wherein each of the plural predetermined times are concurrently monitored;

a determining step to determine if one of plural counters, each of which counts a quantity of ink ejection from a corresponding print head, has counted to a threshold value, wherein each of the plural counters are concurrently monitored;

a moving step to move a carriage laterally in a first direction to raise the wiper blades in a case that at least one of the plural predetermined times has elapsed since the last wiping or in a case that one of the counters has counted to the threshold value; and a wiping step to wipe each of the print heads with a respective one of the raised wiper blades as the carriages moves in a second direction opposite to the first direction.

42. The computer-readable memory medium of claim 41, wherein each of the plural predetermined times corresponds to a type of print head.

43. The computer-readable memory medium of claim 41, wherein the threshold value depends on the type of print head used during printing.

* * * * *

UNITED STATES PATENT AND TRADEMARK OFFICE

CERTIFICATE OF CORRECTION

PATENT NO. : 6,299,278 B1
DATED : October 9, 2001
INVENTOR(S) : Tadashi Hanabusa et al.

It is certified that error appears in the above-identified patent and that said Letters Patent is hereby corrected as shown below:

Title page,
Item [56], References Cited, U.S. PATENT DOCUMENTS, insert

| | | | | |
|---|---|---|---|---|
| -- 4,692,778 | 9/1987 | Yoshimura et al. | 346 | 145 |
| 4,962,390 | 10/1990 | Yoshimura et al. | 347 | 42 |
| 5,090,827 | 2/1992 | Hirano et al. | 400 | 185 |
| 5,258,773 | 11/1993 | Arakawa et al. | 347 | 37 |
| 5,266,974 | 11/1993 | Koitabashi et al. | 347 | 33 |
| 5,416,395 | 5/1995 | Hiramatsu | 318 | 600 |
| 5,495,271 | 2/1996 | Koitabashi et al. | 347 | 23 |
| 5,534,898 | 7/1996 | Kashino et al. | 347 | 33 |
| 5,512,926 | 4/1996 | Uchikata et al. | 347 | 86 |
| 5,534,899 | 7/1996 | Uchikata et al. | 347 | 49 |
| 5,670,997 | 9/1997 | Sugimoto et al. | 347 | 30 |
| 5,671,000 | 9/1997 | Hirabayashi et al. | 347 | 86 -- |

Column 6,
Line 37, "ig" should read -- is --.

Column 7,
Line 1, "cartridges" should read -- Cartridges --.

Column 8,
Line 58, "go" should read -- so --.

Column 9,
Line 10, "Thug," should read -- Thus, --; and
"56" should read -- 58 --.

UNITED STATES PATENT AND TRADEMARK OFFICE

CERTIFICATE OF CORRECTION

PATENT NO. : 6,299,278 B1
DATED : October 9, 2001
INVENTOR(S) : Tadashi Hanabusa et al.

It is certified that error appears in the above-identified patent and that said Letters Patent is hereby corrected as shown below:

Column 13,
Line 41, "arm;" should read -- arm; and --.
Line 42, "and" should be deleted.

Signed and Sealed this

Twenty-third Day of April, 2002

*Attest:*

*Attesting Officer*

JAMES E. ROGAN
*Director of the United States Patent and Trademark Office*